US010184244B2

(12) United States Patent
Choi

(10) Patent No.: US 10,184,244 B2
(45) Date of Patent: Jan. 22, 2019

(54) SHEAR LINK INCLUDING REPLACEABLE COVER PLATES

(71) Applicant: INDUSTRY-ACADEMIC COOPERATION FOUNDATION, CHOSUN UNIVERSITY, Gwangju (KR)

(72) Inventor: Jae Hyouk Choi, Gwangju (KR)

(73) Assignee: INDUSTRY-ACADEMIC COOPERATION FOUNDATION, CHOSUN UNIVERSITY, Gwangju (KR)

( * ) Notice: Subject to any disclaimer, the term of this patent is extended or adjusted under 35 U.S.C. 154(b) by 0 days.

(21) Appl. No.: 15/535,720

(22) PCT Filed: Apr. 19, 2017

(86) PCT No.: PCT/KR2017/004174

§ 371 (c)(1),
(2) Date: Jun. 14, 2017

(87) PCT Pub. No.: WO2017/183898

PCT Pub. Date: Oct. 26, 2017

(65) Prior Publication Data

US 2018/0202151 A1 Jul. 19, 2018

(30) Foreign Application Priority Data

Apr. 19, 2016 (KR) ..... 10-2016-0047809

(51) Int. Cl.

| | |
|---|---|
| ***E04B 1/98*** | (2006.01) |
| ***E04G 23/02*** | (2006.01) |
| ***E04H 9/02*** | (2006.01) |
| ***E04B 1/24*** | (2006.01) |
| *E04B 1/21* | (2006.01) |

(52) U.S. Cl.

CPC ..... *E04B 1/98* (2013.01); *E04B 1/2403* (2013.01); *E04G 23/02* (2013.01);

(Continued)

(58) Field of Classification Search

CPC ..... E04B 1/98; E04H 9/021; E04H 9/028; E04G 23/0218

(Continued)

(56) References Cited

U.S. PATENT DOCUMENTS 5,412,913 A * 5/1995 Daniels ..... E04B 1/24 212/177
5,630,298 A * 5/1997 Tsai ..... E04H 9/021 52/167.1

(Continued)

FOREIGN PATENT DOCUMENTS

JP 11-181920 6/1999
JP 11181920 A * 7/1999

(Continued)

*Primary Examiner* — Brian E Glessner
*Assistant Examiner* — Adam G Barlow
(74) *Attorney, Agent, or Firm* — Eric L. Lane; Green Patent Law

(57) ABSTRACT

The present invention relates to a shear link including replaceable cover plates. The shear link includes first and second combination plates combined with a structure, a main frame that includes both ends fixed to the first and second combination plates respectively and a hollow formed in a center to pass therethrough forward and backward, first and second cover plates positioned to come into contact with left and right sides of the main frame respectively to cover the hollow and including a plurality of through holes passing therethrough forward and backward, and a combination unit that separably combines the main frame with the first and second cover plates.

In the shear link including replaceable cover plates according to the present invention, since the first and second cover plates are separably combined with the main frame by the combination unit, the first and second cover plates deformed (Continued)

by an external force may be easily separated from the main frame to reduce time and costs consumed for a replacement operation.

7 Claims, 4 Drawing Sheets

(52) U.S. Cl.
CPC ..... *E04G 23/0218* (2013.01); *E04H 9/02* (2013.01); *E04H 9/021* (2013.01); *E04H 9/028* (2013.01); *E04B 1/215* (2013.01); *E04B 2001/2406* (2013.01); *E04B 2001/2415* (2013.01); *E04B 2001/2418* (2013.01); *E04B 2001/2442* (2013.01); *E04B 2001/2448* (2013.01); *E04B 2001/2457* (2013.01); *E04B 2001/2496* (2013.01); *E04G 2023/0251* (2013.01)

(58) Field of Classification Search
USPC ..... 52/167.1, 167.8, 837, 838, 839
See application file for complete search history.

(56) References Cited

U.S. PATENT DOCUMENTS

| | | | | |
|---|---|---|---|---|
| 6,681,536 | B1 * | 1/2004 | Isoda | E04H 9/02 52/167.8 |
| 6,799,400 | B2 * | 10/2004 | Chuang | F16F 7/12 188/371 |
| 7,076,926 | B2 * | 7/2006 | Kasai | E04H 9/02 52/167.1 |
| 8,881,491 | B2 * | 11/2014 | Christopoulos | E04H 9/022 52/167.1 |
| 8,910,455 | B2 * | 12/2014 | Yang | E04C 3/292 29/428 |
| 9,316,014 | B2 * | 4/2016 | Chou | E04H 9/14 |
| 9,322,170 | B2 * | 4/2016 | Tsai | E04C 3/04 |
| 2010/0251637 | A1 * | 10/2010 | Nishimoto | E04H 9/021 52/167.8 |

FOREIGN PATENT DOCUMENTS

| | | | |
|---|---|---|---|
| KR | 10-2013-0027786 | | 3/2013 |
| KR | 20130027786 | A * | 3/2013 |

* cited by examiner

SHEAR LINK INCLUDING REPLACEABLE COVER PLATES

TECHNICAL FIELD

The present invention relates to a shear link including replaceable cover plates, and more particularly, to a shear link including replaceable cover plates, capable of easily replacing a cover plate deformed by an externally applied force.

BACKGROUND ART

Recently, frequency of occurrence of earthquakes and magnitude thereof has been increased worldwide. When such earthquakes occur and building structures receive horizontal external forces, distortions or similarly horizontal movements occur. Particularly, distortions that occur at building structures or towers may give a serious shock to conditions of a structure and additionally may cause collapse of the structure.

Accordingly, various earthquake-proof reinforcing methods for increasing earthquake-proof performance against external forces applied to building structures have been developed and used.

As earthquake-proof reinforcing methods generally used at home and abroad, an earthquake-proof reinforcing method using hydraulic dampers, an earthquake-proof reinforcing method using circular steel pipe dampers, an earthquake-proof reinforcing method using steel dampers and the like are used.

Among existing technologies, the earthquake-proof reinforcing method using hydraulic dampers is a technology generally used in Japan where severe earthquakes frequently occur nationwide, which has a relatively improved design to provide a smooth external environment and excellent earthquake-proof reinforcing performance. However, considering domestic environmental factors, excessive construction costs are necessary. Also, in view of frequency or magnitude of domestic earthquakes, there is concern for unnecessarily excessive reinforcement. The earthquake-proof reinforcing method using steel dampers is a technology that has been developed at home and abroad and recently used and consumes relatively low construction costs. However, since the whole dampers are integrated, large amounts of time and cost are consumed for replacement or repair when the dampers are deformed due to an applied external force.

DISCLOSURE OF INVENTION

Technical Problem

It is an aspect of the present invention to provide a shear link including replaceable cover plates, capable of easily separating and replacing a cover plate deformed by an external force.

Technical Solution

A shear link including replaceable cover plates according to the present invention includes first and second combination plates combined with a structure, a main frame that includes both ends fixed to the first and second combination plates respectively and a hollow formed in a center to pass therethrough forward and backward, first and second cover plates positioned to come into contact with left and right sides of the main frame respectively to cover the hollow and including a plurality of through holes passing therethrough forward and backward, and a combination unit that separably combines the main frame with the first and second cover plates.

The hollow may have a quadrangular shape, and the main frame may include a first slit extended from a right top corner of the hollow to a right top corner of the main frame, a second slit extended from a right bottom corner of the hollow to a right bottom corner of the main frame, a third slit extended from a left top corner of the hollow to a left top corner of the main frame, and a fourth slit extended from a left bottom corner of the hollow to a left bottom corner of the main frame.

The through holes may be arranged along a virtual reference line having a certain tilt angle with respect to a longitudinal center line of the first and second cover plates.

The reference line may be extended to be tilted at a tilt angle of 45° with respect to the longitudinal center line of the first and second cover plates.

First and second combination holes may be formed at edges of the first and second cover plates facing each other and interconnection holes may be formed in the main frame at positions facing the first and second combination holes. Here, the combination unit may include a combination bolt inserted into the first and second combination holes and the interconnection hole and a combination nut fastened to an end of the combination bolt to fix the first and second cover plates to the main frame.

Advantageous Effects

In the shear link including replaceable cover plates according to the present invention, since the first and second cover plates are separably combined with the main frame by the combination unit, the first and second cover plates deformed by an external force may be easily separated from the main frame to reduce time and costs consumed for a replacement operation.

BEST MODE FOR INVENTION

Hereinafter, a shear link including replaceable cover plates according to embodiments of the present invention will be described in more detail with reference to the attached drawings.

Figure 1:
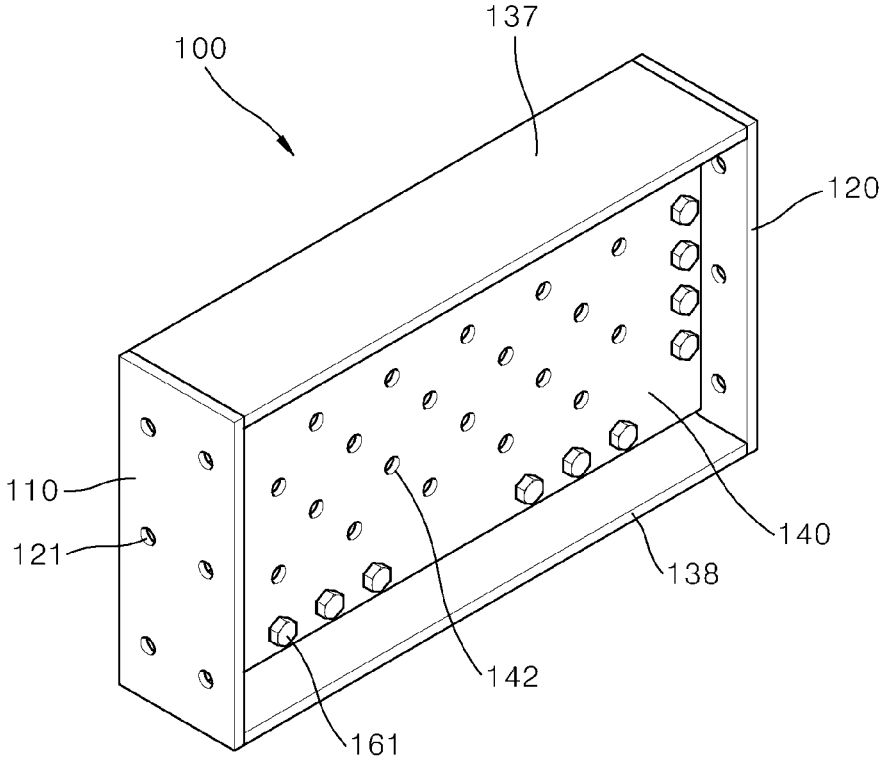
FIG. 1 is a perspective view of a shear link including replaceable cover plates according to embodiments of the present invention.
Figure 2:
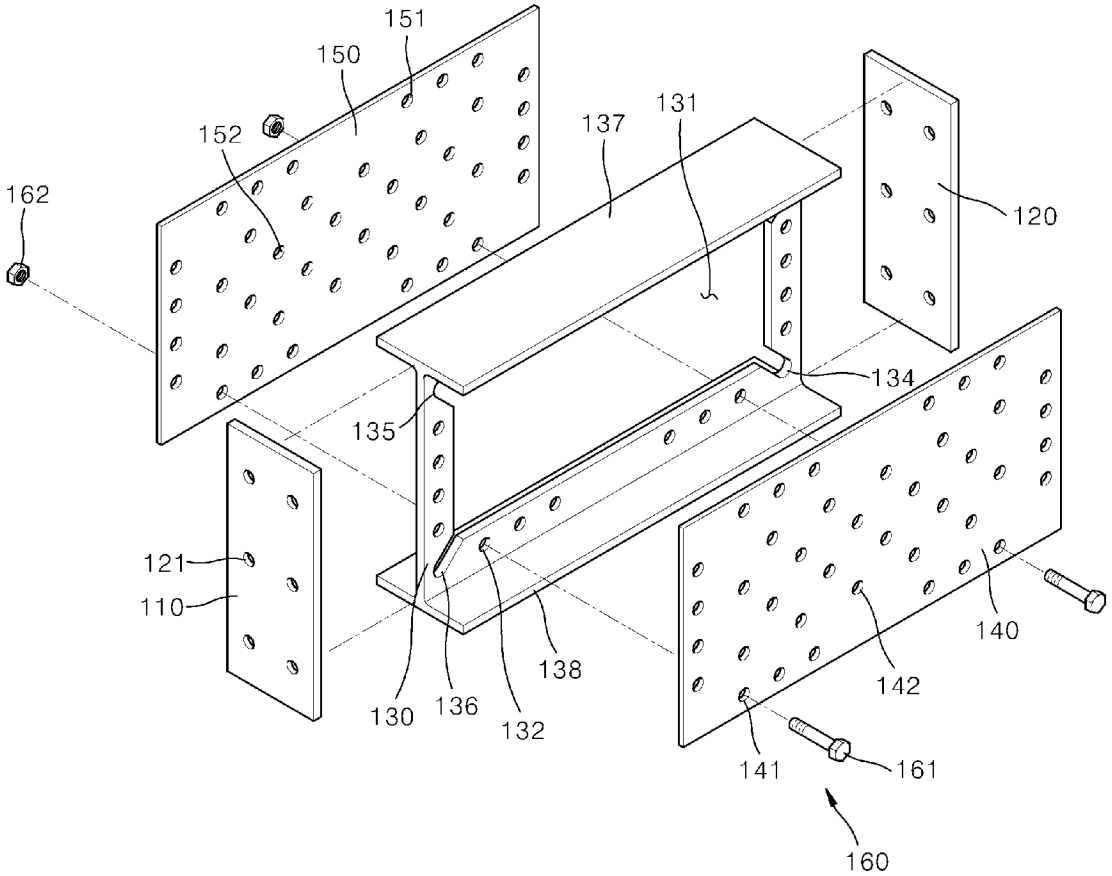
FIG. 2 is an exploded perspective view of the shear link including the replaceable cover plates of FIG. 1.
Figure 3:
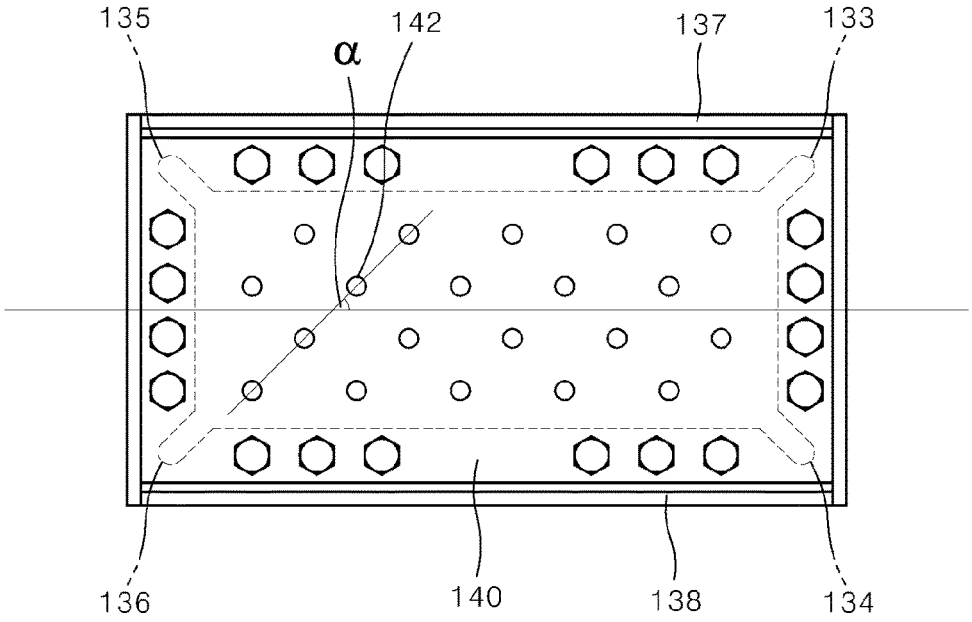
FIG. 3 is a front view of the shear link including the replaceable cover plates of FIG. 1.
Figure 4:
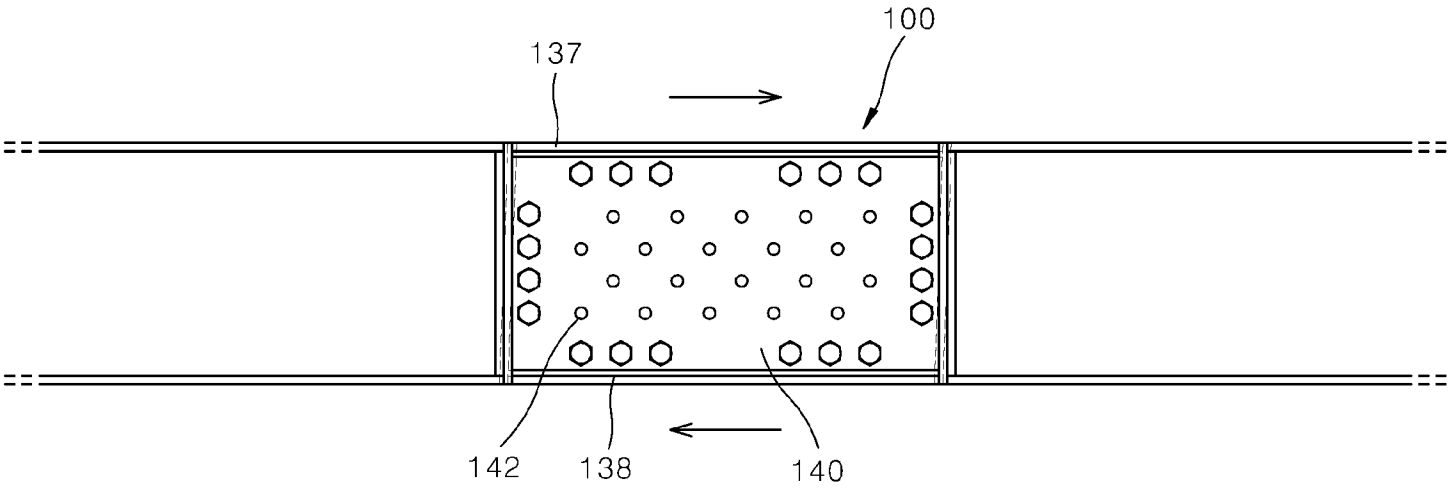
FIG. 4 is a front view of a structure in which the shear link including the replaceable cover plates of FIG. 1 is installed.

FIGS. 1 to 4 illustrate a shear link 100 including replaceable cover plates according to embodiments of the present invention.

Referring to the drawings, the shear link 100 including replaceable cover plates includes first and second combination plates 110 and 120 combined with a structure, a main frame 130 including both ends fastened to the first and second combination plates 110 and 120 and a hollow 131 that passes through a center forward and backward, first and second cover plates 140 and 150 positioned to come into contact with left and right sides of the main frame 130 to cover the hollow 131 and including a plurality of through holes 142 and 152 that pass through forward and backward, and a combination unit 160 that separably combines the main frame 130 with the first and second cover plates 140 and 150.

The first and second combination plates 110 and 120 are formed in a plate shape having a certain thickness and vertically extended and are combined with left and right ends of the main frame 130, respectively. Here, a plurality of combination holes 121 for fastening the first and second combination plates 110 and 120 to a structure of a building may be formed at the first and second combination plates 110 and 120 and a shape or a combination structure of the first and second combination plates 110 and 120 may be variable according to a shape of a beam of the building or structure.

The main frame 130 is formed in a quadrangular plate shape having a certain vertical width and laterally extended by a certain length, and the first and second combination plates 110 and 120 are welded on the left and right ends of the main frame 130. Also, an upper plate 137 and a lower plate 138 are fixed at top and bottom of the main frame 130 respectively to be fixed to the structure. The upper plate 137 and the lower plate 138 are formed in a plate shape having a certain thickness and laterally extended and may include the plurality of combination holes 121 for being fixed to the structure of the building.

The main frame 130 includes the hollow 131 having a quadrangular shape at the center. Also, the main frame 130 includes a first slit 133 extended from a right top corner of the hollow 131 to a right top corner of the main frame 130, a second slit 134 extended from a right bottom corner of the hollow 131 to a right bottom corner of the main frame 130, a third slit 135 extended from a left top corner of the hollow 131 to a left top corner of the main frame 130, and a fourth slit 136 extended from a left bottom corner of the hollow 131 to a left bottom corner of the main frame 130. Left and right deformation ratios of the main frame 130 increase due to the first to fourth slits 133, 134, 135, and 136 when an external force is laterally applied.

Meanwhile, the main frame 130 includes a plurality of interconnection holes 132 spaced apart along an edge. The interconnection holes 132 may be formed in the main frame 130 at positions facing first and second combination holes 141 and 151 of the first and second cover plates 140 and 150 which will be described below.

The first cover plate 140 is formed in a rectangular shape that has a certain vertical length and is laterally extended by a certain width. Here, the first cover plate 140 may be formed to have a larger area than the hollow 131 to cover the hollow 131. Also, the first cover plate 140 includes a plurality of such first combination holes 141 formed along an edge to be spaced apart.

Meanwhile, the first cover plate 140 includes a plurality of such through holes 142 passing therethrough forward and backward. The through holes 142 are arranged along virtual reference lines having a certain tilt angle with respect to a longitudinal center line of the first cover plate 140. Here, a tilt angle between the reference lines and the longitudinal center line of the first cover plate 140 may be 45°. Since the first cover plate 140 has a relatively high deformation rate when an external force is laterally applied, due to the through holes 142, the first cover plate 140 may damp even a great external force.

The first cover plate 140 configured as described above is positioned to allow a rear surface thereof to come into contact with a front surface of the main frame 130.

The second cover plate 150 is formed in a rectangular shape that has a certain vertical length and is laterally extended by a certain width. Here, the second cover plate 150 may be formed to have a larger area than the hollow 131 to cover the hollow 131. Also, the second cover plate 150 includes a plurality of such second combination holes 151 formed along an edge to be spaced apart. The second combination holes 151 are formed at positions facing those of the first combination holes 141 of the first cover plate 140.

Meanwhile, the second cover plate 150 includes a plurality of such through holes 152 passing therethrough forward and backward. The through holes 152 are arranged along virtual reference lines having certain tilt angles with respect to a longitudinal center line of the second cover plate 150. Here, a tilt angle between the reference lines and the longitudinal center line of the second cover plate 150 may be 45°. Since the second cover plate 150 has a relatively high deformation rate when an external force is laterally applied due to the through holes 152, the second cover plate 150 may damp even a great external force.

The second cover plate 150 configured as described above is positioned to allow a front surface thereof to come into contact with a rear surface of the main frame 130.

The combination unit 160 includes a plurality of combination bolts 161 inserted into the first and second combination holes 141 and 151 and the interconnection hole 132 and a plurality of combination nuts 162 fastened to ends of the combination bolts 161 to fix the first and second cover plates 140 and 150 to the main frame 130. Each of the combination bolts 161 includes a screw portion inserted into the first and second combination holes 141 and 151 and the interconnection hole 132 to pass therethrough and including a screw thread formed on an inner circumferential surface and a head portion formed at one end of the screw portion to have a larger cross-sectional area than areas of the first and second combination holes 141 and 151 to be interfered with the first and second cover plates 140 and 150.

Each of the combination nuts 162 may be screw-combined with the other end of the screw portion and may be formed to have a larger cross-sectional area than areas of the first and second combination holes 141 and 151 to be interfered with the first and second cover plates 140 and 150.

The above-described shear link 100 including replaceable cover plates is connected to a structure and receives an external force when the external force is applied to the structure and exhausts the external force applied to the structure while plastic deformation, that is, crushes or damages of the first and second cover plates 140 and 150 occurs anteriorly to the structure. Through this, it is possible to minimize the occurrence of damage when the external force applied to the structure exceeds a supporting intensity.

Here, since the first and second cover plates 140 and 150 are separably combined with the main frame 130 by the combination unit 160, the first and second cover plates 140 and 150 deformed by the external force may be easily separated from the main frame 130 to reduce time and costs consumed for a replacement operation.

Although the present invention has been described with reference to the embodiments shown in the drawings, it would be understood that they are merely examples and various modifications and equivalents thereof may be made by one of ordinary skill in the art.

Accordingly, the scope of the present invention would be determined by only the attached claims.

The invention claimed is:

1. A shear link comprising replaceable cover plates, comprising:

first and second combination plates combined with a structure;

a main frame that comprises both ends fixed to the first and second combination plates respectively and a hollow formed in a center to pass therethrough forward and backward;

first and second cover plates positioned to come into contact with left and right sides of the main frame respectively to cover the hollow and comprising a plurality of through holes passing therethrough forward and backward; and a combination unit that separably combines the main frame with the first and second cover plates;

wherein the hollow has a quadrangular shape, and the main frame comprises a first slit extended from a right top corner of the hollow to a right top corner of the main frame, a second slit extended from a right bottom corner of the hollow to a right bottom corner of the main frame, a third slit extended from a left top corner of the hollow to a left top corner of the main frame, and a fourth slit extended from a left bottom corner of the hollow to a left bottom corner of the main frame.

2. The shear link according to claim 1, wherein the through holes are arranged along a virtual reference line having a certain tilt angle with respect to a longitudinal center line of the first and second cover plates.

3. The shear link of claim 2, wherein the reference line is extended to be tilted at a tilt angle of 45° with respect to the longitudinal center line of the first and second cover plates.

4. The shear link according to claim 1, wherein first and second combination holes are formed at edges of the first and second cover plates facing each other and interconnection holes are formed in the main frame at positions facing the first and second combination holes, and wherein the combination unit comprises a combination bolt inserted into the first and second combination holes and the interconnection hole and a combination nut fastened to an end of the combination bolt to fix the first and second cover plates to the main frame.

5. The shear link according to claim 1, wherein the through holes are arranged along a virtual reference line having a certain tilt angle with respect to a longitudinal center line of the first and second cover plates.

6. The shear link according to claim 5, wherein the reference line is extended to be tilted at a tilt angle of 45° with respect to the longitudinal center line of the first and second cover plates.

7. The shear link according to claim 1, wherein first and second combination holes are formed at edges of the first and second cover plates facing each other and interconnection holes are formed in the main frame at positions facing the first and second combination holes, and wherein the combination unit comprises a combination bolt inserted into the first and second combination holes and the interconnection hole and a combination nut fastened to an end of the combination bolt to fix the first and second cover plates to the main frame.

* * * * *